US010657924B2

(12) United States Patent
Yen et al.

(10) Patent No.: US 10,657,924 B2
(45) Date of Patent: May 19, 2020

(54) DISPLAY APPARATUS AND OPERATING METHOD THEREOF

(71) Applicant: InnoLux Corporation, Miao-Li County (TW)

(72) Inventors: Chung-Wen Yen, Miao-Li County (TW); Kuo-Cheng Tung, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/045,766

(22) Filed: Jul. 26, 2018

(65) Prior Publication Data

US 2019/0057672 A1 Feb. 21, 2019

(30) Foreign Application Priority Data

Aug. 21, 2017 (CN) ..... 2017 1 0718507

(51) Int. Cl.

| | |
|---|---|
| ***G09G 5/02*** | (2006.01) |
| ***G09G 5/10*** | (2006.01) |
| ***G09G 3/34*** | (2006.01) |
| ***G09G 3/20*** | (2006.01) |

(52) U.S. Cl.

CPC ..... *G09G 5/02* (2013.01); *G09G 3/2003* (2013.01); *G09G 3/34* (2013.01); *G09G 3/3406* (2013.01); *G09G 5/10* (2013.01); *G09G 2320/064* (2013.01); *G09G 2320/0666* (2013.01); *G09G 2340/06* (2013.01)

(58) Field of Classification Search

CPC ..... G09G 5/02; G09G 5/10; G09G 2320/064; G09G 2320/0666

See application file for complete search history.

(56) References Cited

U.S. PATENT DOCUMENTS

| | | | | |
|---|---|---|---|---|
| 2008/0203899 | A1* | 8/2008 | Miller | C09K 11/883 313/499 |
| 2010/0013748 | A1* | 1/2010 | Cok | H04N 9/67 345/83 |
| 2012/0201452 | A1* | 8/2012 | Pettigrew | H04N 1/60 382/165 |
| 2014/0263672 | A1* | 9/2014 | Mesh-Iliescu | G06K 19/0614 235/494 |

(Continued)

FOREIGN PATENT DOCUMENTS

| | | |
|---|---|---|
| KR | 10-2018-0026216 A | 3/2018 |
| PH | 1-1999-02822 | 3/2006 |

*Primary Examiner* — Shaheda A Abdin

(74) *Attorney, Agent, or Firm* — Winston Hsu

(57) ABSTRACT

The present disclosure provides a display apparatus and an operating method thereof. The display apparatus includes a control unit outputting a first signal and a display module coupled to the control unit. The display module continuously displays a first image in a first frame time based on the first signal, the first image has a first pattern, and a first ratio of an area of the first pattern to an area of the first image ranges from 5% to 30%. The first pattern at a first time point in the first frame time has a color located at a first coordinate position in a CIE 1931 chromaticity diagram, the first pattern at a second time point in the first frame time has another color located at a second coordinate position in the CIE 1931 chromaticity diagram, and the first coordinate position is different from the second coordinate position.

16 Claims, 10 Drawing Sheets

(56) References Cited

U.S. PATENT DOCUMENTS

| | | | |
|---|---|---|---|
| 2018/0068639 | A1 | 3/2018 | Kim |
| 2018/0356684 | A1 | 12/2018 | Chang |
| 2019/0035325 | A1 | 1/2019 | Takanashi |

* cited by examiner

DISPLAY APPARATUS AND OPERATING METHOD THEREOF

CROSS REFERENCE TO RELATED APPLICATION

The present application claims the benefit of China application serial no. 201710718507.4, filed Aug. 21, 2017, and the entire contents of which are incorporated herein by reference.

BACKGROUND OF THE DISCLOSURE

1. Field of the Disclosure

The present disclosure relates to a display apparatus and an operating method thereof, and more particularly, to a display apparatus with a high dynamic range (HDR) and an operating method thereof.

2. Description of the Prior Art

Display apparatus is a device for providing images, such that the images can be viewed by the user. Since that, performance of the images directly influences perception of the user. Recently, for improving image quality viewed by the user, color gamut of the display apparatus is usually raised to enrich colorfulness of image color in this art, so that wide color gamut display apparatuses have been developed, and image standards of wide color gamut have been provided. For example, past standard of BT. 709 advances to be a standard of DCI-P3, even a standard of BT. 2020. However, perception of human visual system to color relates to not only chromaticity shown in chromaticity diagram but also brightness, in which chromaticity and brightness may constitute chromaticity space. Accordingly, display apparatus with HDR is further produced in consideration of the chromaticity space. Nevertheless, the display apparatus with HDR still has some disadvantages, and to continuously improve the display apparatus with HDR is an objective in this field.

SUMMARY OF THE DISCLOSURE

An embodiment of the present disclosure provides a display apparatus including a control unit and a display module. The control unit outputs a first signal. The display module is coupled to the control unit, and the display module continuously displays a first image in a first frame time based on the first signal, in which the first image has a first pattern, and a first ratio of an area of the first pattern to an area of the first image ranges from 5% to 30%. The first pattern at a first time point in the first frame time has a color located at a first coordinate position in a CIE 1931 chromaticity diagram, the first pattern at a second time point in the first frame time has another color located at a second coordinate position in the CIE 1931 chromaticity diagram, and the first coordinate position is different from the second coordinate position.

Another embodiment of the present disclosure provides an operating method of a display apparatus. First, a control unit and a display module are provided, in which the display module is coupled to the control unit. Then, a first signal is output to the display module through the control unit, such that the display module continuously displays a first image in a first frame time based on the first signal, in which the first image has a first pattern, and a first ratio of an area of the first pattern to an area of the first image ranges from 5% to 30%. The first pattern at a first time point in the first frame time has a color located at a first coordinate position in a CIE 1931 chromaticity diagram, the first pattern at a second time point in the first frame time has another color located at a second coordinate position in the CIE 1931 chromaticity diagram, and the first coordinate position is different from the second coordinate position.

These and other objectives of the present disclosure will no doubt become obvious to those of ordinary skill in the art after reading the following detailed description of the embodiment that is illustrated in the various figures and drawings.

DETAILED DESCRIPTION

The present disclosure may be understood by reference to the following detailed description, taken in conjunction with the drawings as described below so as to enable a person skilled in the pertinent art to make and use the present disclosure. Embodiments are not intended to limit the scope of the present disclosure, and the technical features in the embodiments described herein can be replaced or recombined. Also, it is understood that term "include" and/or "have" as used herein is referred to existence of features, regions, steps, operations and/or devices, and one or more features, regions, steps, operations and/or devices may be present or added. It should be understood that when a device, such as a layer or region, is referred to as being "on" another device (or its variant), it can be directly on another device, or intervening devices may also be present. It should be also understood that when a device is referred to as being "coupled to" another device (or its variant), it can be directly connected to another device or indirectly connected (such as electrically connected) to another device through one or more devices.

Figure 1:
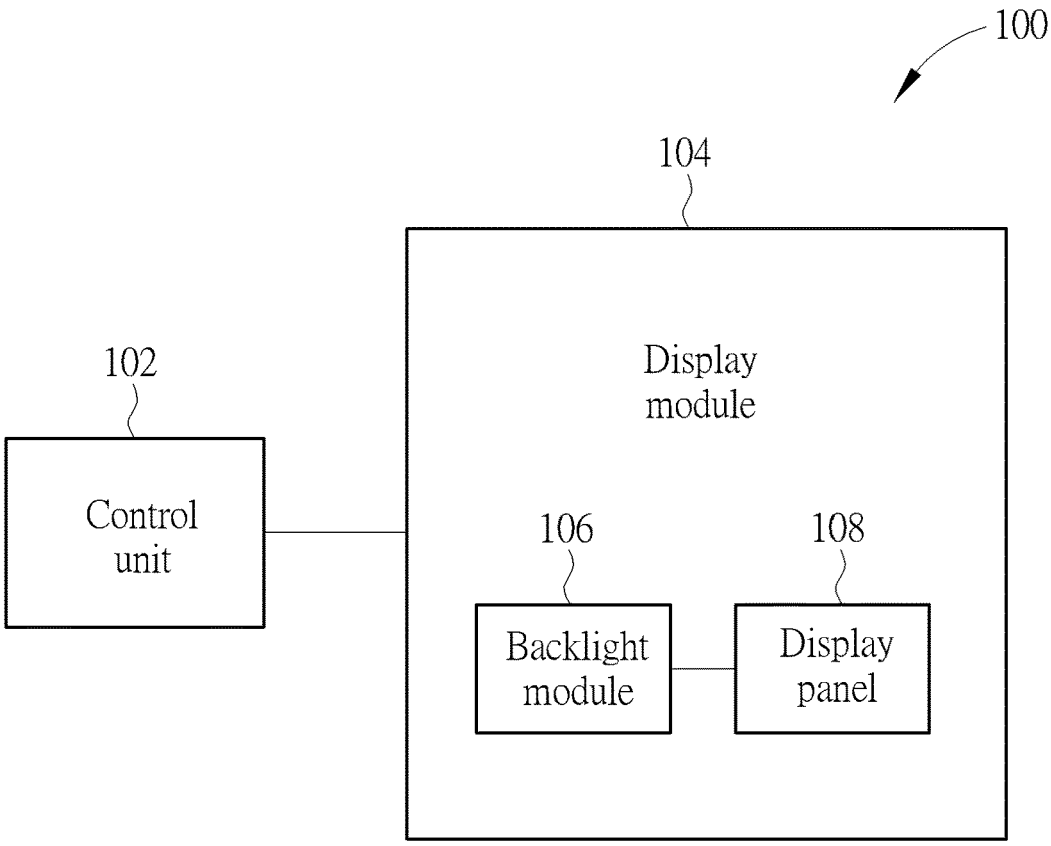
FIG. 1 is a schematic functional block diagram illustrating a display apparatus according to an embodiment of the present disclosure.
Figure 2:
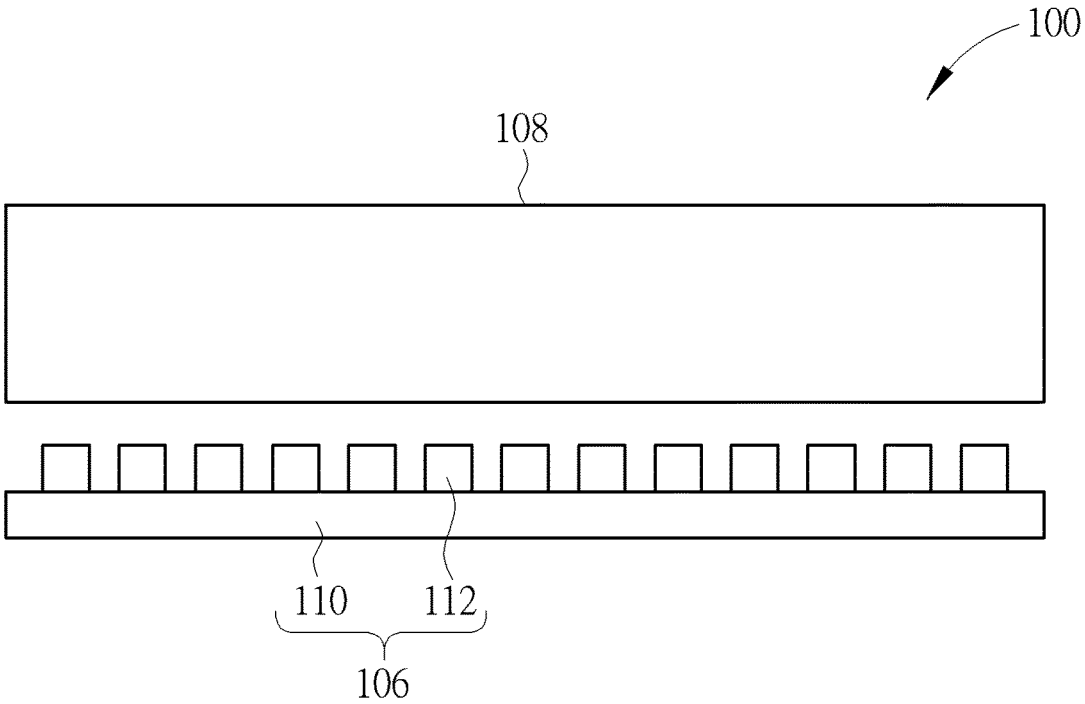
FIG. 2 is a schematic diagram illustrating a side view of the display apparatus according to a first embodiment of the present disclosure.

Referring to FIG. 1 and FIG. 2, FIG. 1 is a schematic functional block diagram illustrating a display apparatus according to an embodiment of the present disclosure, and FIG. 2 is a schematic diagram illustrating a side view of the display apparatus according to a first embodiment of the present disclosure, while the control unit is omitted. As shown in FIG. 1 and FIG. 2, the display apparatus 100 includes a control unit 102 and a display module 104. The display module 104 is coupled to the control unit 102, and the control unit 102 is configured to transmit a display signal to the display module 104. Since the display module 104 of this embodiment is a display module that has high dynamic range (HDR), the display module 104 may display an image with HDR after receiving the display signal. In this embodiment, the display module 104 may include a backlight module 106 and a display panel 108. The display panel 108 may be a non-self-luminous display panel, such as a liquid crystal display panel. The backlight module 106 may be disposed under the display panel 108 for providing a backlight, and the present disclosure is not limited thereto. In another embodiment, the display apparatus may be a self-luminous display apparatus, such as an organic light-emitting-diode display apparatus, a micro light-emitting diode display apparatus or a quantum dot display apparatus, so the display apparatus may not include the backlight module, and the backlight brightness described below may serve as a luminous brightness of the self-luminous display apparatus. In this embodiment, the backlight module 106 may include a circuit board 110 and a plurality of light-emitting devices 112, and the light-emitting devices 112 are disposed right under the display panel 108 and on the circuit board 110, so that light generated from the light-emitting devices 112 enters the display panel 108 from bottom of the display panel 108 so as to reduce brightness loss. That is, the backlight module 106 of this embodiment is a direct type backlight module, but the present disclosure is not limited thereto. In other embodiments, the backlight module 106 is an edge type backlight module.

Figure 3:
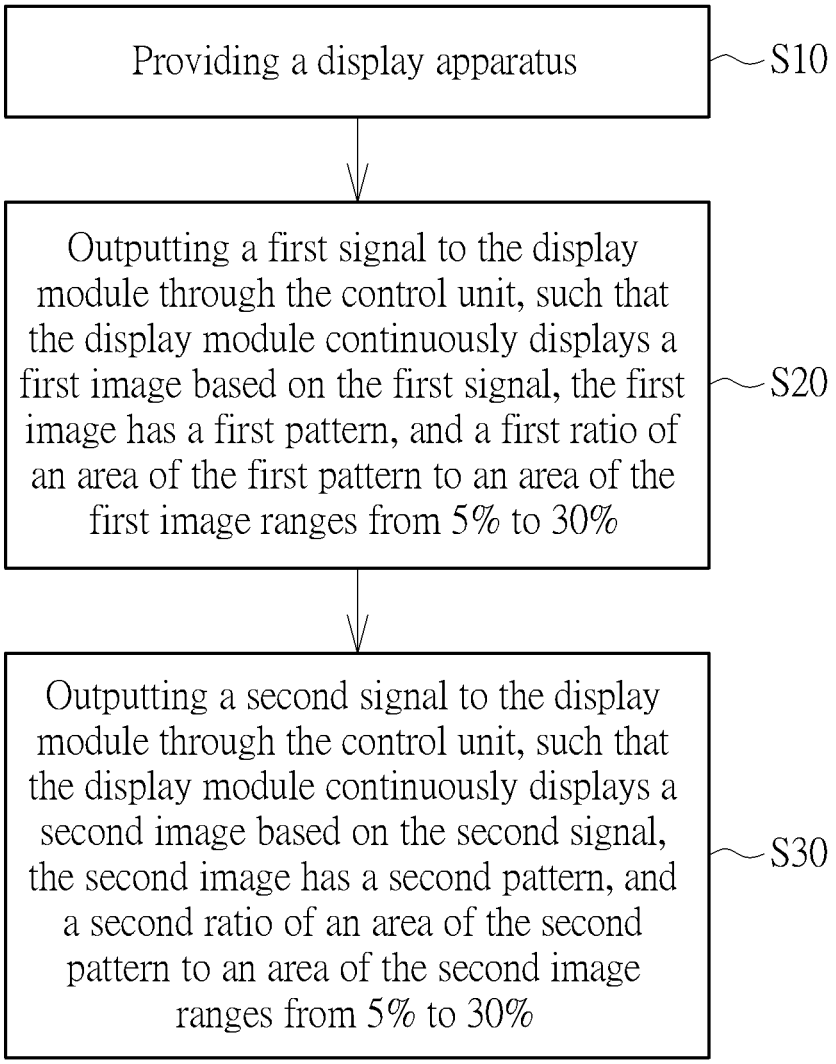
FIG. 3 is a flow chart illustrating the operating method of the display apparatus according to the first embodiment of the present disclosure.
Figure 4:
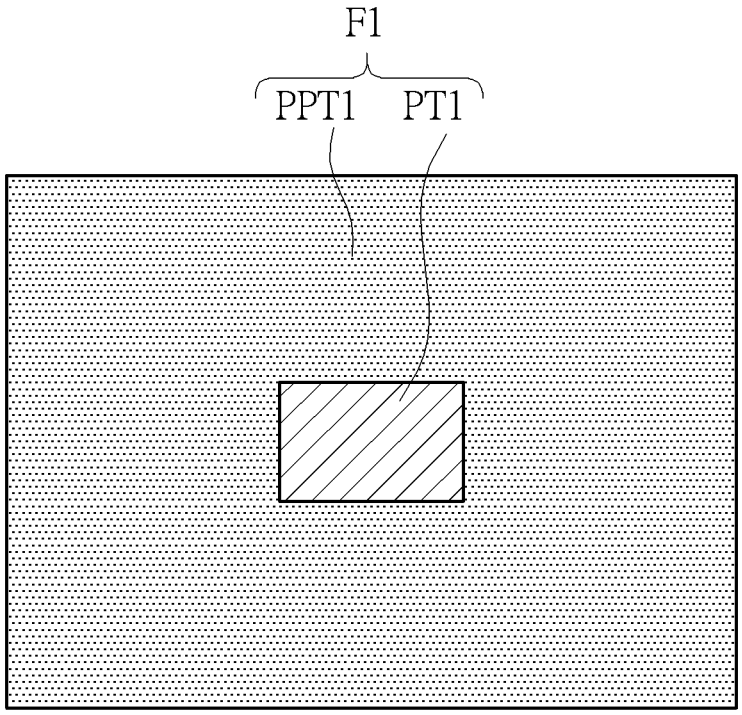
FIG. 4 is a schematic diagram illustrating an image displayed by the display apparatus according to the first embodiment of the present disclosure.
Figure 5:
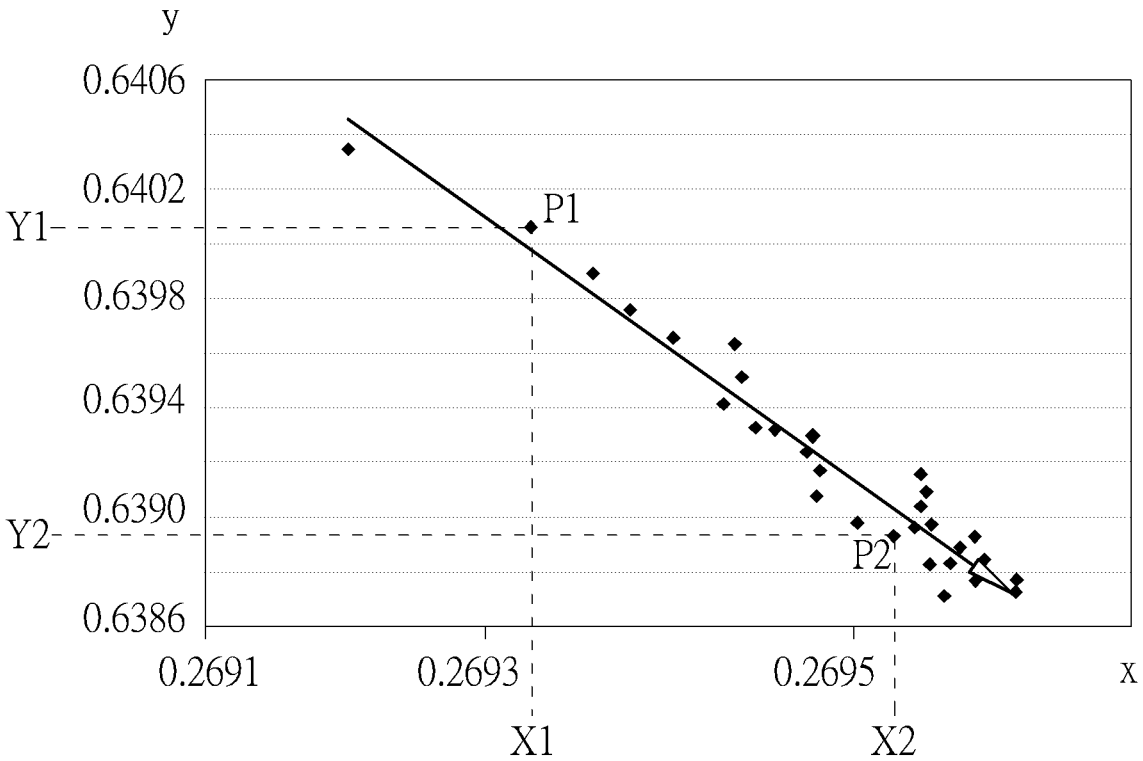
FIG. 5 is a CIE 1931 chromaticity diagram illustrating coordinate positions of the first position as time progresses according to the first embodiment of the present disclosure.
Figure 6:
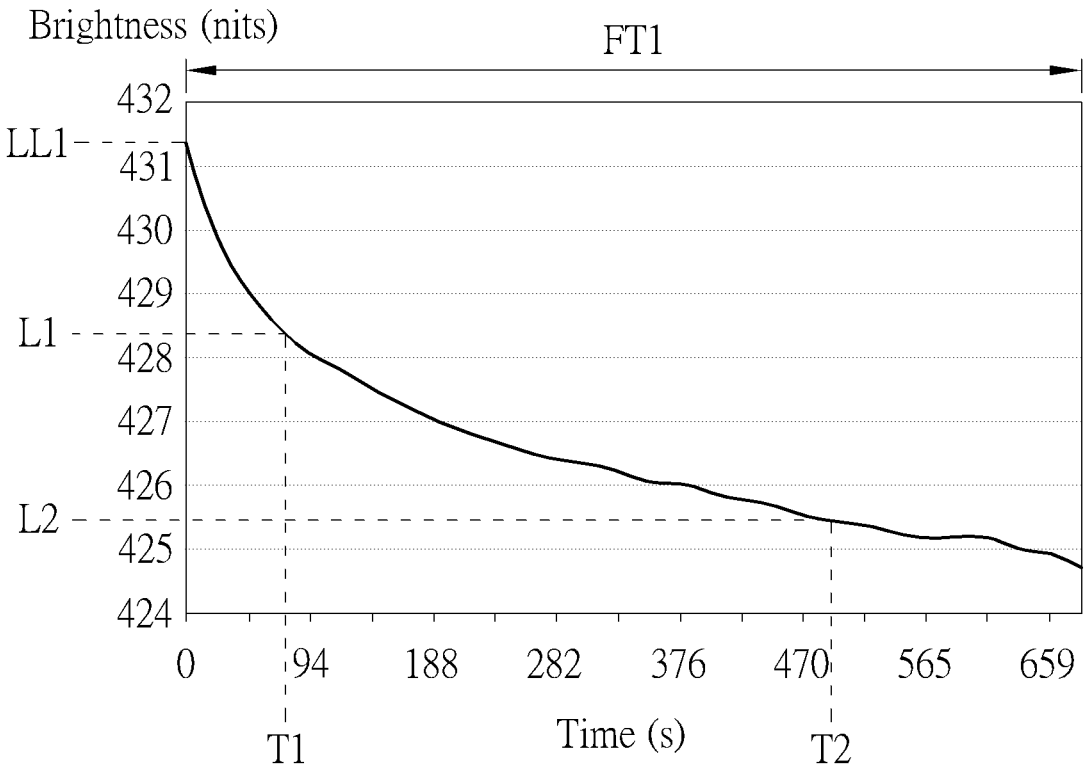
FIG. 6 is a schematic diagram illustrating a relation between brightness of the first pattern and time according to the first embodiment of the present disclosure.

The following description further details an operating method of the display apparatus of this embodiment. FIG. 3 is a flow chart illustrating the operating method of the display apparatus according to the first embodiment of the present disclosure, FIG. 4 is a schematic diagram illustrating an image displayed by the display apparatus according to the first embodiment of the present disclosure, FIG. 5 is a CIE 1931 chromaticity diagram illustrating coordinate positions of the first position as time progresses according to the first embodiment of the present disclosure, and FIG. 6 is a schematic diagram illustrating a relation between brightness of the first pattern and time according to the first embodiment of the present disclosure. As shown in FIG. 3, the operating method of the display apparatus 100 of this embodiment may include the following steps. First, a step S10 is performed to provide the above-mentioned display apparatus 100. Then, as shown in FIG. 4 and FIG. 6, a step S20 is performed to output a first signal to the display module 104 through the control unit 102, such that the display module 104 continuously displays a first image F1 in a first frame time FT1 based on the first signal. The first image F1 has a first pattern PT1, and a first ratio of an area of the first pattern PT1 to an area of the first image F1 ranges from 5% to 30%. In this embodiment, the first pattern PT1 may for example a green pattern. Specifically, the first image F1 may further have a peripheral pattern PPT1 surrounding the first pattern PT1, and the peripheral pattern PPT1 and the first pattern PT1 constitute a whole of the first image F1. The peripheral pattern PPT1 may be for example a black pattern. It is noted that when the display module 104 is operated in the HDR mode, which means current for driving each light-emitting device 112 is increased to intensify the brightness from each light-emitting device 112, the brightness of the first pattern PT1 is increased by significantly increasing the backlight brightness generated from the backlight module 106, which raises a contrast ratio between the first pattern PT1 and the peripheral pattern PPT1, and improves image quality of the first image F1. For example, when the display module 104 displays sparkle of fireworks, in order to let user clearly see the sparkle, the display module 104 will increase brightness of the sparkle, so as to increase contrast ratio between the sparkle and a night view surrounding the sparkle. Accordingly, a clear image can be provided to the user.

Referring to FIG. 5 and FIG. 6, the first pattern PT1 is the green pattern and the first ratio of the first pattern used is 10% for example, but the present disclosure is not limited thereto. At a first time point T1 in the first frame time FT1, the green pattern has a color located at a first coordinate position P1 in the CIE 1931 chromaticity diagram, and at a second time point T2 in the first frame time FT1, the green pattern has another color located at a second coordinate position P2 in the CIE 1931 chromaticity diagram. The first time point T1 is different from the second time point T2, and the first coordinate position P1 is different from the second coordinate position P2. In other words, under the condition of maintaining the first ratio of the area of the first pattern to the area of the first image, the color of the green pattern is shifted during displaying. It should be noted that the position of a color of the pattern in the CIE 1931 chromaticity diagram can be adjusted through controlling the current of driving the light emitting device, but the present disclosure is not limited thereto.

In this embodiment, the second time point T2 is later than the first time point T1. The first coordinate position P1 has a first x coordinate value X1 and a first y coordinate value Y1, and the second coordinate position P2 has a second x coordinate value and a second y coordinate value Y2, in which the second x coordinate value X2 is greater than the first x coordinate value X1, and the second y coordinate value Y2 is less than the first y coordinate value Y1. That is, when the first pattern is the green pattern, as time progresses, the x coordinate value of the color of the green pattern is gradually increased, and the y coordinate value of the color of the green pattern is gradually reduced, in which the variance of the x coordinate value and the variance of the y coordinate value of the color of the green pattern are shown as an arrow direction in FIG. 5. Additionally, a first difference exists between the first y coordinate value Y1 and the second y coordinate value Y2, a second difference exists between the second x coordinate value X2 and the first x coordinate value X1, and a ratio of the first difference to the second difference is defined as a first proportion that represents a varying range of the color of the green pattern as time progresses.

Refer to FIG. 6 again. Since the backlight module 106 of this embodiment is direct type, the backlight module 106 doesn't require generating brightness close to its brightness limit when being operated in the HDR mode, so that the display module 108 can be operated in the HDR mode in the whole of the first frame time FT1. In this embodiment, the first pattern PT1 at the first time point T1 has a first brightness L1, the first pattern PT1 at the second time point T2 has a second brightness L2, and the second brightness L2 is less than the first brightness L1. That is, the brightness of the first pattern PT1 is reduced as time progresses, so the light-emitting devices 112 can be prevented from damage or deterioration due to being driven in the HDR mode for a long time (which is driven to increase brightness for a long time). Accordingly, useful life of the light-emitting devices 112 can be prolonged. Also, the first pattern PT1 may have a first largest brightness LL1 in the first frame time FT1.

Figure 7:
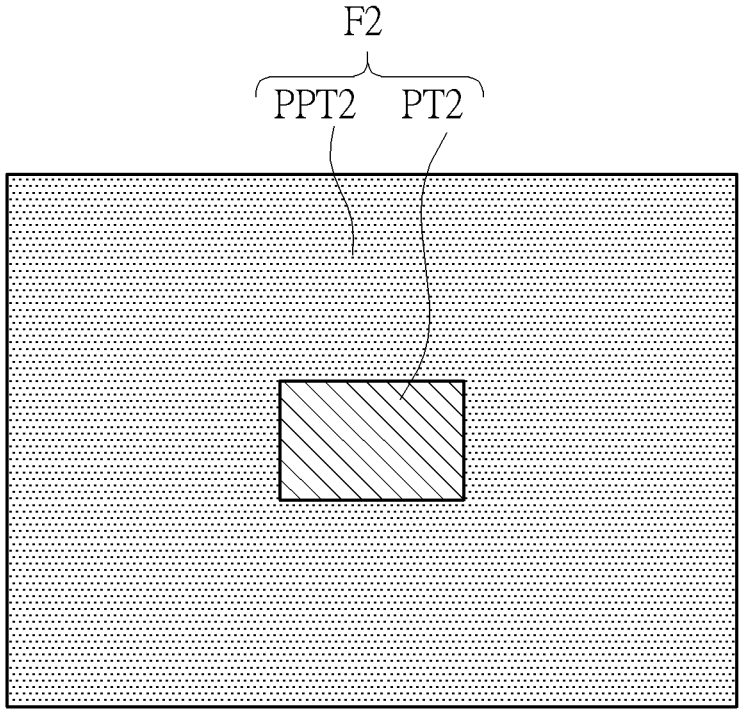
FIG. 7 is a schematic diagram illustrating a second image displayed by the display apparatus according to the first embodiment of the present disclosure.
Figure 8:
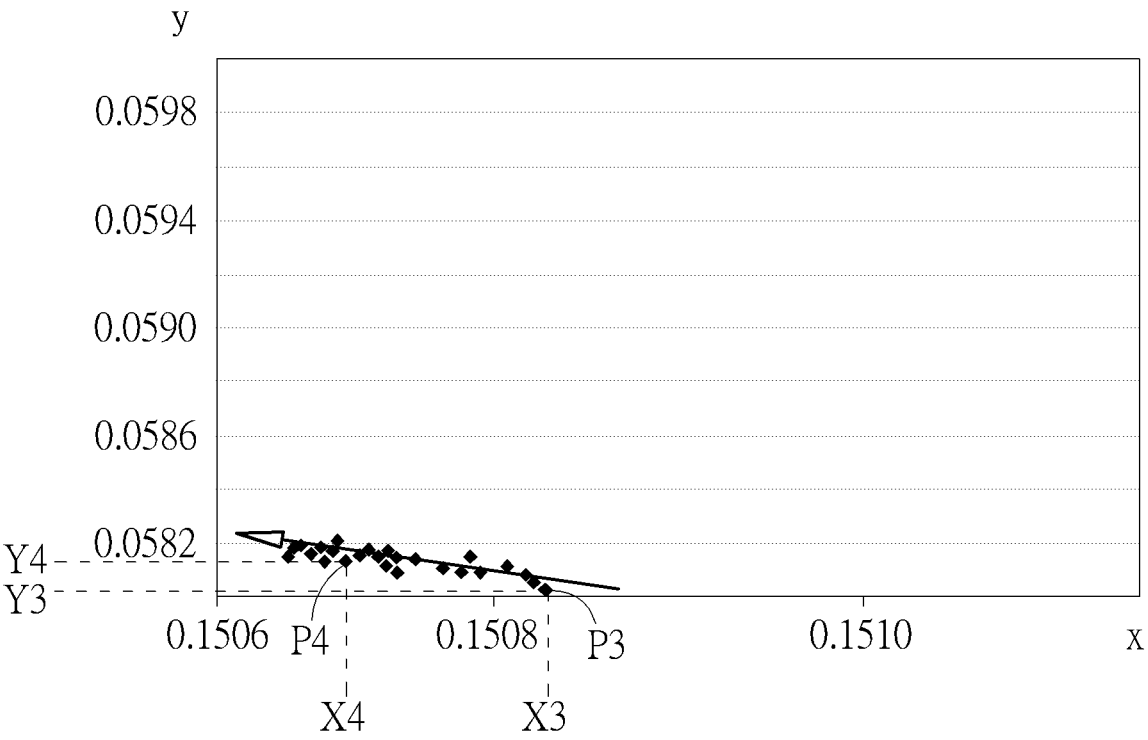
FIG. 8 is a CIE 1931 chromaticity diagram illustrating coordinate positions of a second pattern at different times according to the first embodiment of the present disclosure.
Figure 9:
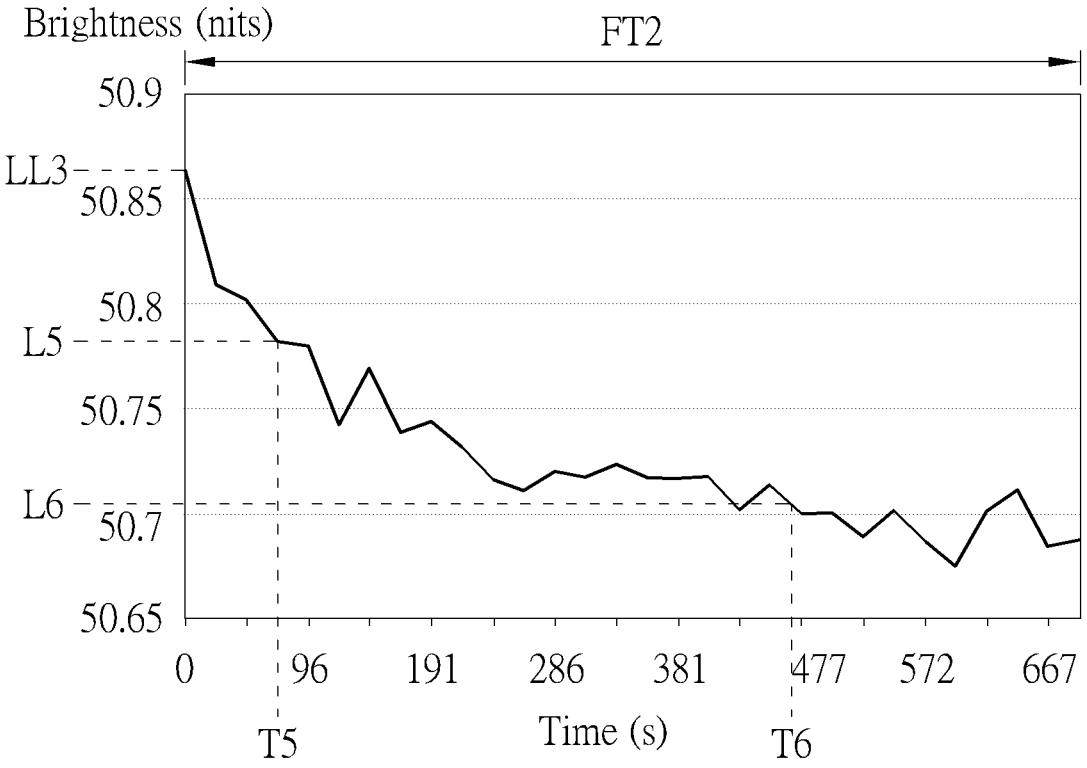
FIG. 9 is a schematic diagram illustrating a relation between brightness of the second pattern and time according to the first embodiment of the present disclosure.

Refer to FIG. 7 to FIG. 9 in combination with FIG. 3. FIG. 7 is a schematic diagram illustrating a second image displayed by the display apparatus according to the first embodiment of the present disclosure, FIG. 8 is a CIE 1931 chromaticity diagram illustrating coordinate positions of a second pattern at different times according to the first embodiment of the present disclosure, and FIG. 9 is a schematic diagram illustrating a relation between brightness of the second pattern and time according to the first embodiment of the present disclosure. As shown in FIG. 3, FIG. 7 and FIG. 9, after the step S20, a step S30 is performed to further output a second signal to the display module 104 through the control unit 102, such that the display module 104 continuously displays a second image F2 that has a second pattern PT2 in a second frame time FT2 based on the second signal, in which a second ratio of an area of the second pattern PT2 to an area of the second image F2 ranges from 5% to 30%. In this embodiment, the second pattern PT2 may be for example a blue pattern. Specifically, the second image F2 may further have a peripheral pattern PPT2 surrounding the second pattern PT2, and the peripheral pattern PPT2 and the second pattern PT2 may constitute a whole of the second image F2. The peripheral pattern PPT2 may be for example a black pattern.

Refer to FIG. 8 and FIG. 9. The second pattern used in FIG. 8 is for example a blue pattern, and the second ration of the second pattern is for example 10%, but the present disclosure is not limited thereto. At a fifth time point T5 in the second frame time FT2, the blue pattern has a color located at a third coordinate position P3 in the CIE 1931 chromaticity diagram, and at a sixth time point T6 in the second frame time FT2, the blue pattern has another color located at a fourth coordinate position P4 in the CIE 1931 chromaticity diagram. The fifth time point T5 is different from the sixth time point T6, and the third coordinate position P3 is different from the fourth coordinate position P4. In other words, under the condition of maintaining the second ratio of the area of the second pattern to the area of the second image, the color of the blue pattern is shifted during displaying.

In this embodiment, the sixth time point T6 is later than the fifth time point T5. The third coordinate position P3 has a third x coordinate value X3 and a third y coordinate value Y3, and the fourth coordinate position P4 has a fourth x coordinate value X4 and a fourth y coordinate value Y4, in which the fourth x coordinate value X4 is less than the third x coordinate value X3, and the fourth y coordinate value Y4 is greater than the third y coordinate value Y3. That is, when the first pattern is the blue pattern, as time progresses, the x coordinate value of the color of the blue pattern is gradually reduced, and the y coordinate value of the color of the blue pattern is gradually increased, in which the variance of the x coordinate value and the variance of the y coordinate value of the color of the blue pattern are shown as the arrow direction in FIG. 8. Moreover, a third difference exists between the fourth y coordinate value Y4 and the third y coordinate value Y3, a fourth difference exists between the third x coordinate value X3 and the fourth x coordinate value X4, and a ratio of the third difference to the fourth difference is defined as a second proportion that represents a varying range of the blue pattern as time progresses. In another embodiment, the first pattern may be the blue pattern, so that the first coordinate position P1 may have the third x coordinate value and the third y coordinate value, and the second coordinate position P2 may have the fourth x coordinate value and the fourth y coordinate value.

Refer to FIG. 5 together with FIG. 8. It is noted that shifted direction of the chromaticity of the green pattern as time progresses and shifted direction of the chromaticity of the blue pattern as time progresses are substantially opposite to each other, so that the shift of the coordinate position of white color formed by the green pattern and the blue pattern as time progresses can be reduced. For example, the first proportion may be greater than the second proportion, which means the varying range of the green pattern as time progresses is greater than the varying range of the blue pattern as time progresses.

Further refer to FIG. 9. The display module 104 also continuously displays the second image F2 in a whole of the second frame time FT2 in the HDR mode. The second frame time FT2 may be identical to or different from the first frame time FT1. Also, the first signal for generating the first image F1 may not overlap the second signal for generating the second image F2, which means the first frame time FT1 may not be connected to the second frame time FT2. In another embodiment, the step S30 for outputting the second signal may be prior to the step S20 for outputting the first signal.

In this embodiment, the second pattern PT2 at the fifth time point T5 has a fifth brightness L5, the second pattern PT2 at the sixth time point T6 has a sixth brightness L6, and the sixth brightness L6 is less than the fifth brightness L5. That is, since the second ratio of the second pattern PT2 is the same as the first ratio of the first pattern PT1, the brightness of the second pattern PT2 is also reduced as time progresses. Accordingly, the light-emitting devices 112 also can be prevented from damage or deterioration due to being driven in the HDR mode for a long time (which is driven to increase brightness for a long time). However, since the color of the second pattern PT2 is different from the color of the first pattern PT1, a reduced range of the brightness of the second pattern PT2 in a predetermined time is different from a reduced range of the brightness of the first pattern PT1 in the same predetermined time. For example, when the second pattern PT2 is a blue pattern, and the first pattern PT1 is a green pattern, the reduced range of the brightness of the second pattern PT2 is less than the reduced range of the brightness of the first pattern PT1. Specifically, a proportion of a difference between the fifth brightness L5 and the sixth brightness L6 to a difference between the fifth time point T5 and the sixth time point is less than a proportion of a difference between the first brightness L1 and the second brightness L2 to a difference between the first time point T1 and the second time point T2. Also, the second pattern PT2 may have a third largest brightness LL3 in the second frame time FT2. When the second pattern PT2 is the blue pattern, and the first pattern PT1 is the green pattern, the first largest brightness LL1 is greater than the third largest brightness LL3.

The backlight module of the present disclosure is not limited to the direct type of the aforementioned embodiment, and the operating method thereof of the present disclosure is not limited by the above-mentioned embodiment and may be different based on different type of backlight module. The following description continues to detail the other embodiments or variant embodiments, and in order to simplify and show the difference between the other embodiments or variant embodiments and the above-mentioned embodiment, the same numerals denote the same components in the following description, and the same parts are not detailed redundantly.

Figure 10:
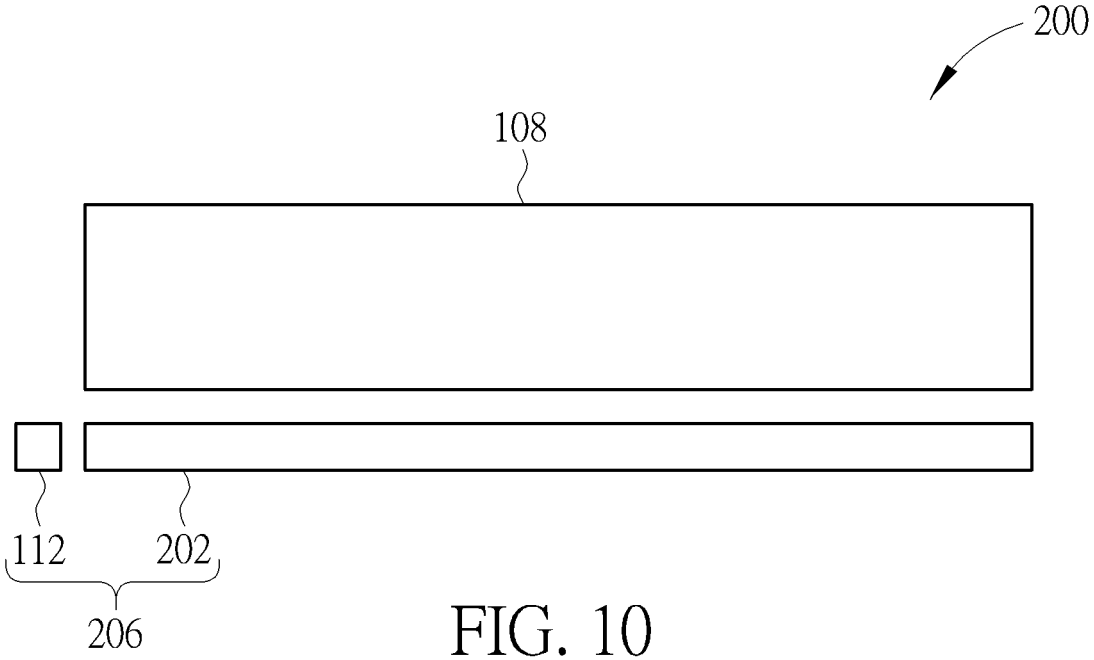
FIG. 10 is a schematic diagram illustrating a side view of a display apparatus according to a second embodiment of the present disclosure.

Refer to FIG. 10, which is a schematic diagram illustrating a side view of a display apparatus according to a second embodiment of the present disclosure. As shown in FIG. 10, as compared with the first embodiment, the backlight module 206 of this embodiment is an edge type backlight module, which means besides the light-emitting devices 112, the backlight module 206 may further include a light guide plate 202 disposed right under the display panel 108, and the light-emitting devices 112 are disposed at a side of the light guide plate, so light generated from the light-emitting device 112 can enter the light guide plate 202 from the side of the light guide plate 202. Also, the number of the light-emitting device 112 in this embodiment is much less than the number of the light-emitting device in the above-mentioned embodiment.

Figure 11:
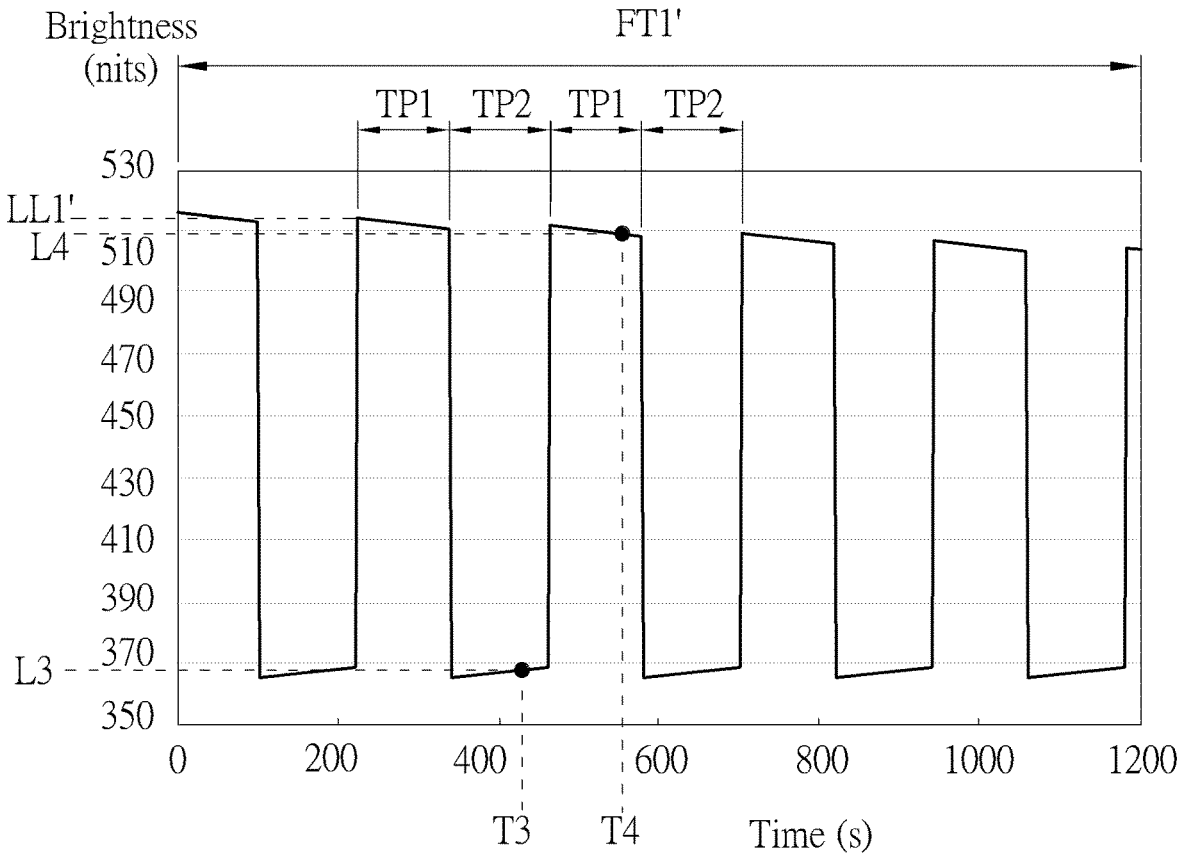
FIG. 11 is a schematic diagram illustrating a relation between brightness of the first pattern and time according to the second embodiment.
Figure 12:
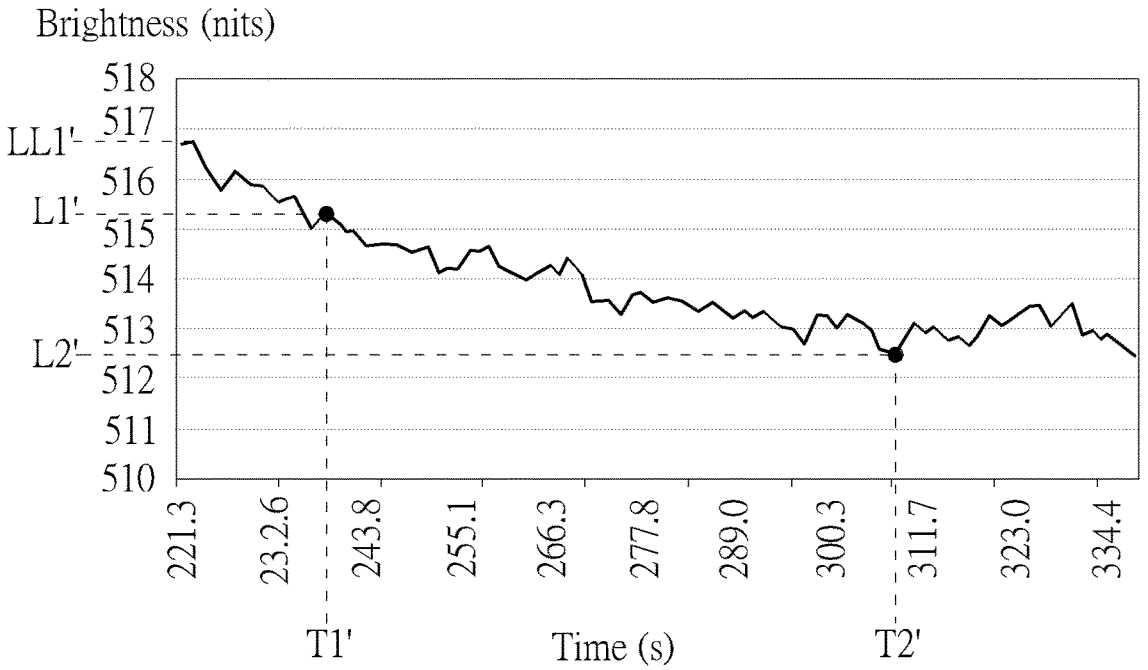
FIG. 12 is an enlarged view of the first period shown in FIG. 11.

Refer to FIG. 11 and FIG. 12 together with FIG. 4. FIG. 11 is a schematic diagram illustrating a relation between brightness of the first pattern and time according to the second embodiment, and FIG. 12 is an enlarged view of the first period shown in FIG. 11, in which the first ratio of the first pattern used in FIG. 11 and FIG. 12 is for example 10% and the first pattern is a white pattern, but the present disclosure is not limited thereto. As shown in FIG. 4 and FIG. 11, the display module 104 continuously displays the first image F1 in the first frame time FT1'. Since the backlight module 206 of this embodiment is edge type, less number of the light-emitting devices 112 is included in the backlight module 206. In order to achieve a required backlight brightness when the backlight module 206 is operated in the HDR mode, each light-emitting device 112 is driven to generate a brightness close to its brightness limit, so as to effectively raise a contrast ratio between the first pattern PT1 and the peripheral pattern PPT1. Thus, as compared with the above-mentioned embodiment, the first frame time FT1' in the step S20 of the operating method of this embodiment may at least include a first period TP1 and at least one second period TP2, in which the display module 104 displays the first image F1 in the HDR mode in the first period TP1, and displays the first image F1 in a normal mode in the second period TP2. Accordingly, the light-emitting devices 112 can be prevented from being turned on continuously in the HDR mode in the whole first frame time FT1', thereby reducing possibility of damage or deterioration to the light-emitting devices 112 under the condition of maintaining the image quality of the HDR mode.

As shown in FIG. 12, the aforementioned first time point T1' and second time point T2' are located in the first period TP1. In this embodiment, the first pattern PT1 at the first time point T1' in the first period TP1 has a first brightness L1', and the first pattern PT1 at the second time point T2' in the first period has a second brightness L2', in which the second brightness L2' is less than the first brightness L1'. That is, in the first period TP1, the brightness of the first pattern PT1 is reduced as time progresses, so the light-emitting devices 112 can be prevented from damage or deterioration due to being driven in the HDR mode for a long time (which is driven to generate the brightness close to the brightness limit for a long time).

Refer to FIG. 11 again. In this embodiment, the second period TP2 is later than the first period TP1, and the first pattern PT1 at a third time point T3 in the second period TP2 has a third brightness L3 less than the first brightness L1' and less than the second brightness L2'. Also, the first frame time FT1' may further include another first period TP1 that is later than the second period TP2. The first pattern TP1 at a fourth time point in the another first period TP1 has a fourth brightness L4 that is greater than the third brightness L3. Since the display module 104 displays the first image F1 in the normal mode in the second period TP2, the brightness of the first pattern PT1 in the second period TP2 is much less than the brightness of the first pattern PT1 in the first period TP1. In the another first period TP1, the display module 104 displays the first image F1 in the HDR mode again, so variance of the brightness of the first pattern PT1 displayed in the another the first period TP1 is substantially identical to variance of the brightness of the first pattern TP1 displayed in the first period TP1. For example, the first frame time FT1' may include a plurality of first periods TP1 and a plurality of second periods TP2, and each first period TP1 and the second period TP2 progress alternately, such that the display module 104 may display the first image F1 in the HDR mode and in the normal mode alternately. Accordingly, continuously turning on the light-emitting devices 112 in the HDR mode in the whole first frame time FT1' can be prevented, so that possibility of damage or deterioration to the light-emitting devices 112 can be reduced under the condition of maintaining the image quality of the HDR mode. It is noted that the first pattern PT1 has a plurality of the first largest brightnesses LL1' respectively in the first periods TP1, and the first largest brightness LL1' corresponding to the former first period TP1 is greater than the first largest brightness LL1' corresponding to the later first period TP1, which means the first largest brightness LL1' may be reduced as time progresses. Possibility of damage or deterioration to the light-emitting devices 112 can be accordingly reduced. In another embodiment, the first largest brightnesses of the first pattern PT1 respectively in the first periods TP1 may also be substantially identical to each other.

Figure 13:
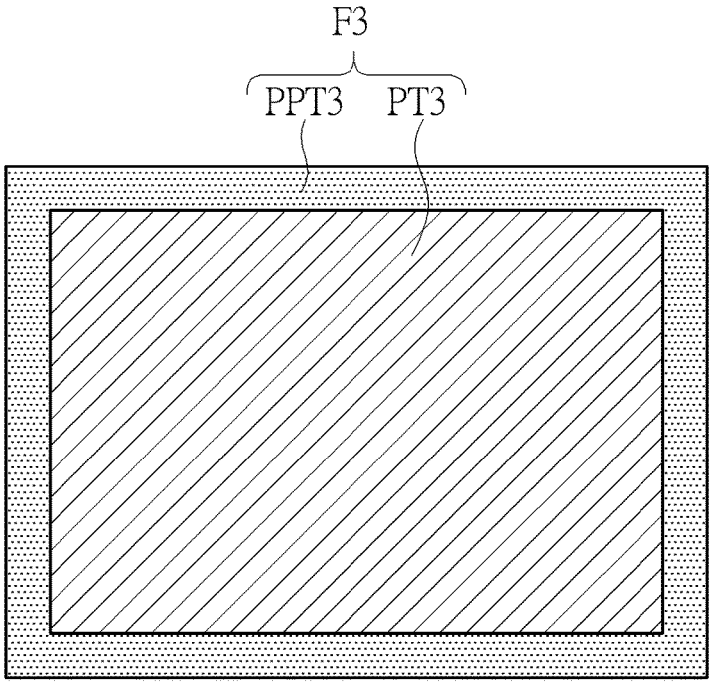
FIG. 13 is a schematic diagram illustrating a third image displayed by the display apparatus according to the second embodiment of the present disclosure.
Figure 14:
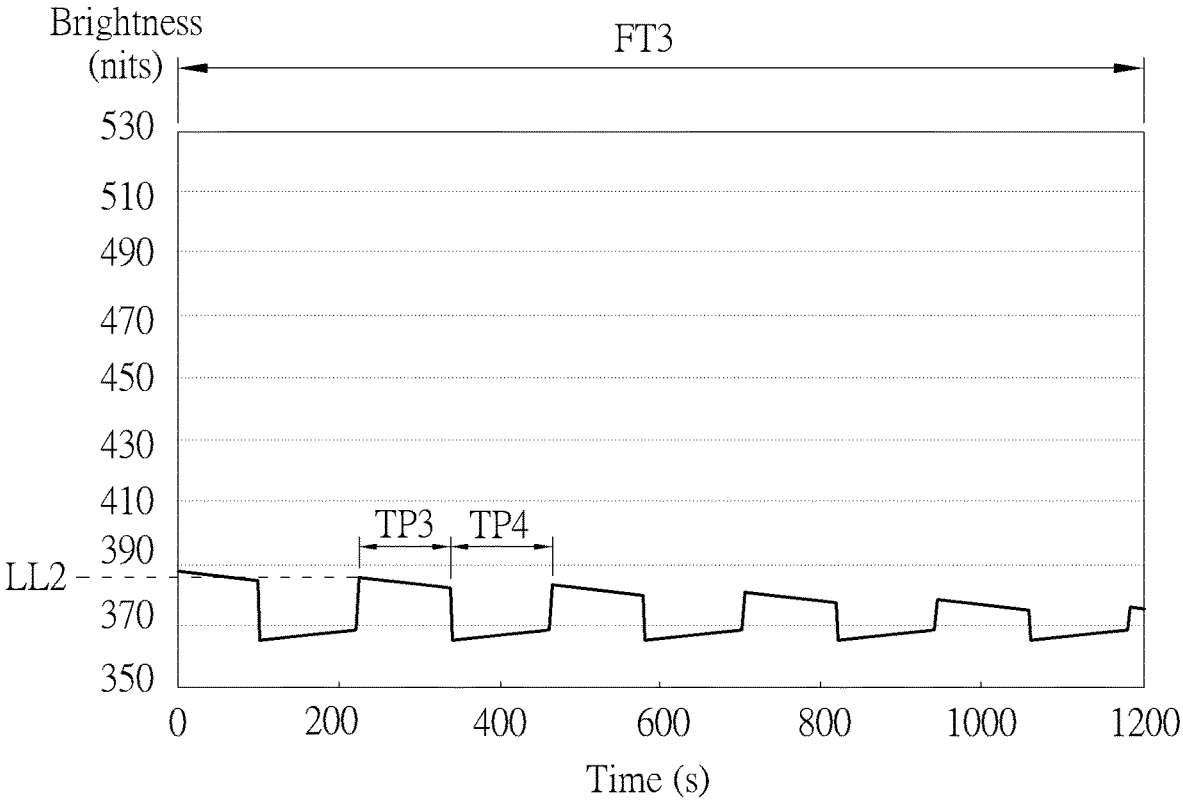
FIG. 14 is a schematic diagram illustrating a relation between brightness of a third pattern and time according to the second embodiment of the present disclosure.

Refer to FIG. 13 and FIG. 14. FIG. 13 is a schematic diagram illustrating a third image displayed by the display apparatus according to the second embodiment of the present disclosure, and FIG. 14 is a schematic diagram illustrating a relation between brightness of a third pattern and time according to the second embodiment of the present disclosure, in which a third ratio of the third pattern used in FIG. 14 is for example 70%, but the present disclosure is not limited thereto. As shown in FIG. 13, after the first image F1 is displayed, a third signal may further be optionally output by the control unit 102, such that the display module 102 can continuously display a third image F3 in a third frame time FT3 based on the third signal. The third image F3 may have a third pattern PT3, and a third ratio of an area of the third pattern PT3 to an area of the third image F3 ranges from 70% to 100%. In this embodiment, the third pattern PT3 may be for example a green pattern. Specifically, the third image F3 may further have a peripheral pattern PPT3 surrounding the third pattern PT3, and the peripheral pattern PPT3 and the third pattern PT3 may constitute a whole of the third image F3. The peripheral pattern PPT3 may be for example a black pattern. In another embodiment, the first pattern PT1 and the third pattern PT3 may also respectively be a pattern with other color, such as a white pattern, a blue pattern or a red pattern.

As shown in FIG. 14, the third frame time FT3 may include a third period TP3 and a fourth period TP4, in which in the third period TP3, the display module 104 is operated in the HDR mode, and in the fourth period TP4, the display module 104 is operated in the normal mode. For example, the third frame time FT3 may be similar to the first frame time FT1 and include a plurality of third period TP3 corresponding to the HDR mode and a plurality of fourth period TP4 corresponding to the normal mode, in which each third period TP3 and each fourth period TP4 progress alternately. The third pattern PT3 has a plurality of second largest brightnesses LL2 respectively in the third periods TP3. In this embodiment, the third signal doesn't overlap the first signal and the second signal, which means the third frame time FT3 is not connected to the first frame time FT1 and the second frame time FT2. In another embodiment, the step for outputting the third signal may be performed before the step S20 for outputting the first signal or between the step S20 for outputting the first signal and the step S30 for outputting the second signal.

Figure 15:
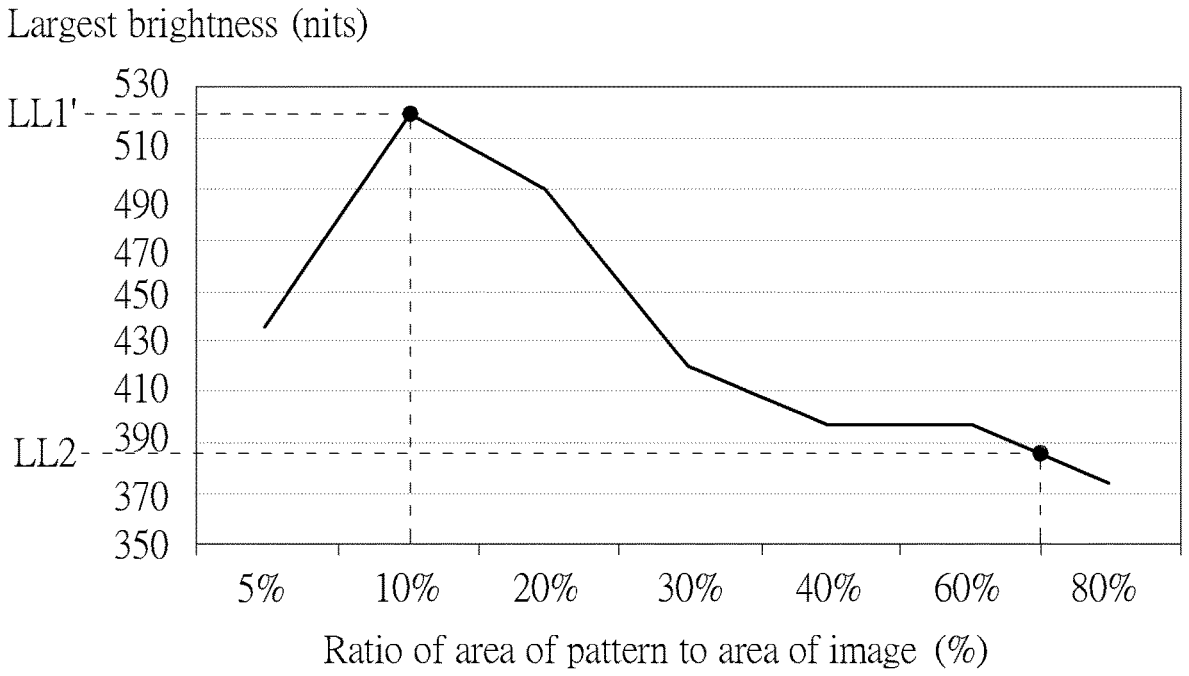
FIG. 15 is a schematic diagram illustrating a relation between a ratio of an area of a pattern to an area of an image and largest brightness of the pattern displayed by the display module according to the second embodiment of the present disclosure.

Refer to FIG. 15 as well as FIG. 11 and FIG. 14. FIG. 15 is a schematic diagram illustrating a relation between a ratio of an area of a pattern to an area of an image and largest brightness of the pattern displayed by the display module according to the second embodiment of the present disclosure. As shown in FIG. 15, the first largest brightness LL1' is greater than the second largest brightness LL2. That is, as the area of the pattern is increased, the largest brightness of the pattern is decreased. For example, when the first ratio is 10%, the first largest brightness LL1' of the first pattern PT1 may be substantially 517 nits, and when the third ratio is 70%, the second largest brightness LL2 of the third pattern PT3 may be substantially 385 nits. Through the variance of the largest brightness, the image of the first pattern PT1, such as sparkle of the firework, can be highlighted when the first ratio of the area of the first pattern PT1 to the area of the image is lower, so as to provide the user a clear image, or the brightness of the third pattern PT3 can be reduced when the third ratio of the area of the third pattern PT3 to the area of the image becomes higher, so as to avoid over high image brightness, thereby providing the user a comfortable image. Moreover, it is noted that when the ratio of the pattern is close to 0%, such as ranges from 0% to 5%, signal to noise ratio of the pattern is increased, and since the largest brightness of the pattern with the ratio close to 0% is less than the largest brightness of the pattern with the ratio ranging from 5% to 30%, the noise is prevented from being enlarged.

Figure 16A:
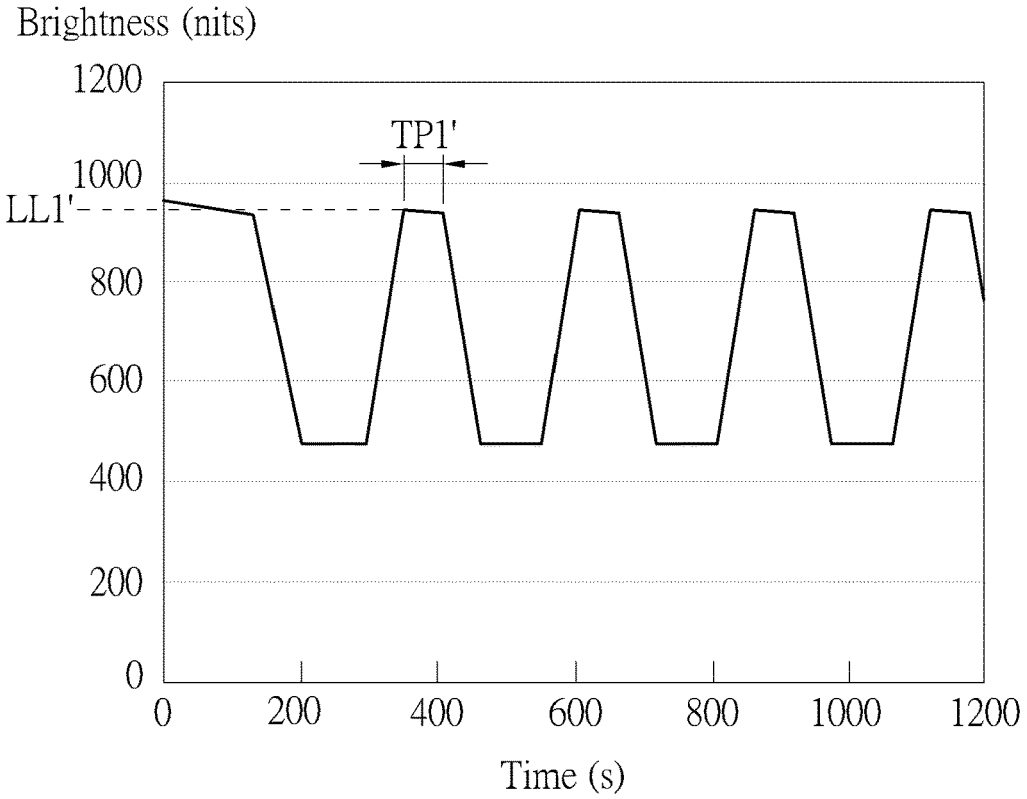
FIG. 16A and FIG. 16B are schematic diagrams illustrating relations between brightnesses of the first patterns with different first ratio and time according to a third embodiment of the present disclosure.
Figure 16B:
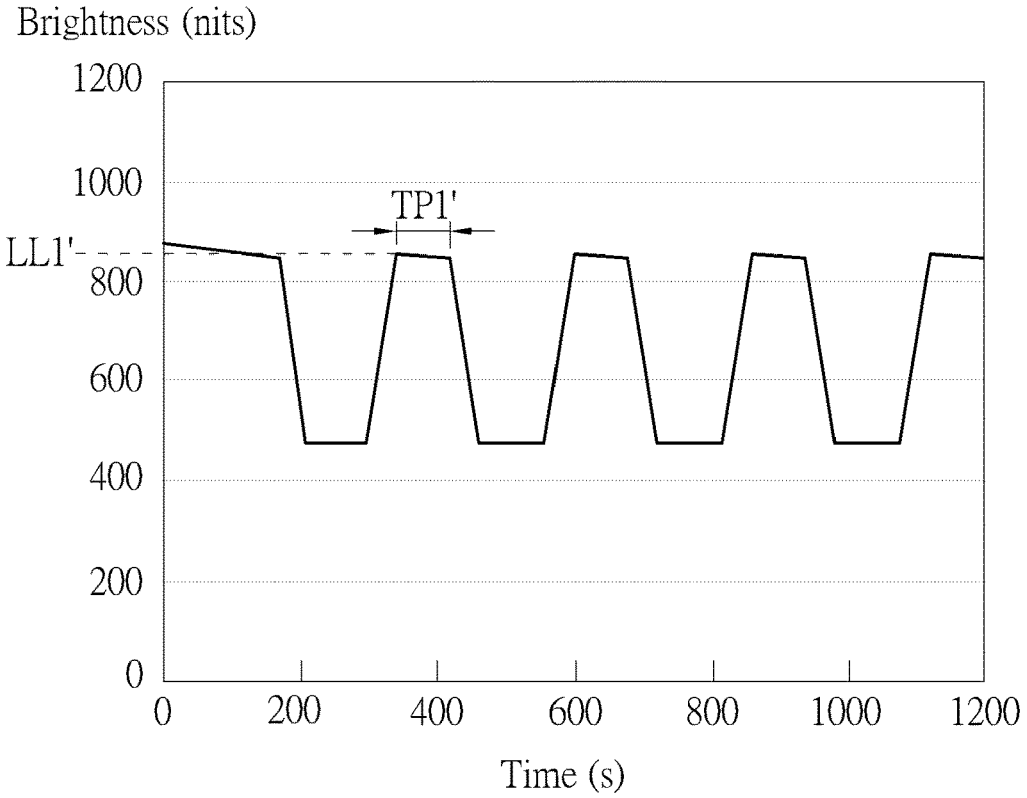

Refer to FIG. 16A and FIG. 16B, which are schematic diagrams illustrating relations between brightnesses of the first patterns with different first ratio and time according to a third embodiment of the present disclosure, in which the first ratio of the first pattern used in FIG. 16A is for example 10%, and the first ratio of the first pattern used in FIG. 16B is for example 20%, but the present disclosure is not limited thereto. As shown in FIG. 16A and FIG. 16B, a length of the first period TP1' for displaying the first pattern PT1 with the first ratio of 10% is less than a length of the first period TP1' for displaying the first pattern PT1 with the first ratio of 20%. In other words, when the first ratio of the first pattern PT1 is less, the first largest brightness LL1' of the first pattern PT1 in the HDR mode is greater, and accordingly, for avoiding deterioration of the light-emitting device, the first period TP1' for displaying the first pattern PT1 in the HDR mode is shorter. For this reason, the light-emitting device can be protected, and its useful life can be prolonged.

As the above-mentioned description, in the operating method of the display apparatus in the present disclosure, shifted direction of the chromaticity of the green pattern as time progresses and shifted direction of the chromaticity of the blue pattern as time progresses are substantially opposite to each other, so that the shift of the coordinate position of white color formed by the green pattern and the blue pattern as time progresses can be reduced. Thus, a clear image or a comfortable image can be provided to the user.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display apparatus, comprising:

a control unit outputting a first signal; and a display module coupled to the control unit, the display module continuously displaying a first image in a first frame time based on the first signal, the first image having a first pattern, and a first ratio of an area of the first pattern to an area of the first image ranging from 5% to 30%, wherein the first pattern at a first time point in the first frame time has a color located at a first coordinate position in a CIE 1931 chromaticity diagram, the first pattern at a second time point in the first frame time has another color located at a second coordinate position in the CIE 1931 chromaticity diagram, and the first coordinate position is different from the second coordinate position;

wherein the first pattern has a first brightness at the first time point in the first frame time, the first pattern has a second brightness at the second time point in the first frame time, the second time point is later than the first time point, and the second brightness is less than the first brightness; and wherein the first frame time comprises a first period and a second period, the first time point and the second time point are located in the first period, the display module continuously displays the first image in the second period based on the first signal, the first pattern has a third brightness at a third time point in the second period, and the third brightness is less than the first brightness and less than the second brightness.

2. The display apparatus according to claim 1, wherein the first pattern is a green pattern, the first coordinate position has a first x coordinate value and a first y coordinate value, the second coordinate position has a second x coordinate value and a second y coordinate value, and wherein the second x coordinate value is greater than the first x coordinate value, and the second y coordinate value is less than the first y coordinate value.

3. The display apparatus according to claim 2, wherein the control unit further outputs a second signal, the display module continuously displays a second image in a second frame time based on the second signal, the second image has a second pattern, a second ratio of an area of the second pattern to an area of the second image ranges from 5% to 30%, wherein the second pattern at a fourth time point in the second frame time has a color located at a third coordinate position in the CIE 1931 chromaticity diagram, the second pattern at a fifth time point in the second frame time has another color located at a fourth coordinate position in the CIE 1931 chromaticity diagram, and the third coordinate position is different from the fourth coordinate position.

4. The display apparatus according to claim 3, wherein the second pattern is a blue pattern, the third coordinate position has a third x coordinate value and a third y coordinate value, the fourth coordinate position has a fourth x coordinate value and a fourth y coordinate value, and wherein the fourth x coordinate value is less than the third x coordinate value, and the fourth y coordinate value is greater than the third y coordinate value.

5. The display apparatus according to claim 4, wherein a first difference exists between the first y coordinate value and the second y coordinate value, a second difference exists between the second x coordinate value and the first x coordinate value, a third difference exists between the fourth y coordinate value and the third y coordinate value, a fourth difference exists between the third x coordinate value and the fourth x coordinate value, and a first proportion of the first difference to the second difference is greater than a second proportion of the third difference to the fourth difference.

6. The display apparatus according to claim 1, wherein the first pattern is a blue pattern, the first coordinate position has a third x coordinate value and a third y coordinate value, the second coordinate position has a fourth x coordinate value and a fourth y coordinate value, and wherein the fourth x coordinate value is less than the third x coordinate value, and the fourth y coordinate value is greater than the third y coordinate value.

7. The display apparatus according to claim 1, wherein the display module continuously displays the first image in another first period later than the second period based on the first signal, the first pattern has a fourth brightness at a fourth time point in the another first period, and the fourth brightness is greater than the third brightness.

8. The display apparatus according to claim 1, wherein the first image has a peripheral pattern surrounding the first pattern, the peripheral pattern and the first pattern constitute the first image, and the peripheral pattern is a black pattern.

9. An operating method of a display apparatus, comprising:

providing a control unit and a display module, wherein the display module is coupled to the control unit; and outputting a first signal to the display module through the control unit, such that the display module continuously displays a first image in a first frame time based on the first signal, wherein the first image has a first pattern, and a first ratio of an area of the first pattern to an area of the first image ranges from 5% to 30%, wherein the first pattern at a first time point in the first frame time has a color located at a first coordinate position in a CIE 1931 chromaticity diagram, the first pattern at a second time point in the first frame time has another color located at a second coordinate position in the CIE 1931 chromaticity diagram, and the first coordinate position is different from the second coordinate position; and wherein the first frame time comprises a first period and a second period, the first time point and the second time point are located in the first period, the first pattern has a first brightness at the first time point in the first period, the first pattern has a second brightness at the second time point in the first period, the second time point is later than the first time point, and the second brightness is less than the first brightness.

10. The operating method according to claim 9, wherein the first pattern is a green pattern, the first coordinate position has a first x coordinate value and a first y coordinate value, the second coordinate position has a second x coordinate value and a second y coordinate value, and wherein the second x coordinate value is greater than the first x coordinate value, and the second y coordinate value is less than the first y coordinate value.

11. The operating method according to claim 10, further comprising:

outputting a second signal through the control unit; and continuously displaying a second image in a second frame time through the display module based on the second signal, the second image having a second pattern, a second ratio of an area of the second pattern to an area of the second image ranging from 5% to 30%, wherein the second pattern at a third time point in the second frame time has a color located at a third coordinate position in the CIE 1931 chromaticity diagram, the second pattern at a fourth time point in the second frame time has another color located at a fourth coordinate position in the CIE 1931 chromaticity diagram, and the third coordinate position is different from the fourth coordinate position.

12. The operating method according to claim 11, wherein the fourth time point is later than the third time point, and the second pattern is a blue pattern, wherein the third coordinate position has a third x coordinate value and a third y coordinate value, the fourth coordinate position has a fourth x coordinate value and a fourth y coordinate value, and wherein the fourth x coordinate value is less than the third x coordinate value, and the fourth y coordinate value is greater than the third y coordinate value.

13. The operating method according to claim 12, wherein a first difference exists between the first y coordinate value and the second y coordinate value, a second difference exists between the second x coordinate value and the first x coordinate value, a third difference exists between the fourth y coordinate value and the third y coordinate value, a fourth difference exists between the third x coordinate value and the fourth x coordinate value, and a first proportion of the first difference to the second difference is greater than a second proportion of the third difference to the fourth difference.

14. The operating method according to claim 9, wherein the first pattern is a blue pattern, the first coordinate position has a third x coordinate value and a third y coordinate value, the second coordinate position has a fourth x coordinate value and a fourth y coordinate value, and wherein the fourth x coordinate value is less than the third x coordinate value, and the fourth y coordinate value is greater than the third y coordinate value.

15. The operating method according to claim 9, wherein the display module continuously displays the first image in the second period based on the first signal, the first pattern has a third brightness at a third time point in the second period, and the third brightness is less than the first brightness and less than the second brightness.

16. The operating method according to claim 15, further comprising continuously displaying the first image in another first period later than the first period based on the first signal, wherein the first pattern has a fourth brightness at a fourth time point in the another first period, and the fourth brightness is greater than the third brightness.

* * * * *